US007991168B2

(12) United States Patent
Wu et al.

(10) Patent No.: US 7,991,168 B2
(45) Date of Patent: Aug. 2, 2011

(54) SERIALLY CONNECTED MICROPHONES

(75) Inventors: Li-Te Wu, Taipei (TW); Wei-Chan Hsu, Cupertino, CA (US)

(73) Assignee: Fortemedia, Inc., Cupertino, CA (US)

( * ) Notice: Subject to any disclaimer, the term of this patent is extended or adjusted under 35 U.S.C. 154(b) by 1113 days.

(21) Appl. No.: 11/748,518

(22) Filed: May 15, 2007

(65) Prior Publication Data

US 2008/0285770 A1 Nov. 20, 2008

(51) Int. Cl.
*H04R 3/00* (2006.01)

(52) U.S. Cl. ..... 381/92; 381/91; 381/122; 381/387; 381/113

(58) Field of Classification Search ..... 381/26, 381/91–92, 122, 111, 113, 387
See application file for complete search history.

(56) References Cited

U.S. PATENT DOCUMENTS 5,337,367 A * 8/1994 Maeda ..... 381/94.7
7,197,146 B2 3/2007 Malvar et al.
7,613,532 B2 * 11/2009 Anderson et al. ..... 700/94
7,751,575 B1 * 7/2010 Baumhauer et al. ..... 381/92
2007/0030989 A1 2/2007 Kates
2007/0086603 A1 4/2007 Lyon et al.

OTHER PUBLICATIONS

PCT search report and written opinion mailed Mar. 10, 2008.
PCT International Search Report, Mar. 10, 2008.

* cited by examiner

*Primary Examiner* — Devona Faulk
*Assistant Examiner* — Disler Paul
(74) *Attorney, Agent, or Firm* — Thomas|Kayden

(57) ABSTRACT

The invention provides a microphone. The microphone receives a first sound signal and at least one second electrical signal and outputs a third electrical signal. In one embodiment, the microphone comprises a transducer and a signal processor. The transducer converts the first sound signal to a first electrical signal. The signal processor has a first input terminal receiving the first electrical signal and at least one second input terminal receiving the at least one second electrical signal, and derives the third electrical signal from the first electrical signal and the second electrical signal. In one embodiment, the at least one second electrical signal is derived from a t least one second sound signal by at least one second microphone located in the vicinity of the microphone. In another embodiment, the at least one second electrical signal comprises a wind noise signal derived from wind pressure by a pressure sensor located in the vicinity of the microphone.

18 Claims, 9 Drawing Sheets

SERIALLY CONNECTED MICROPHONES

BACKGROUND OF THE INVENTION

1. Field of the Invention

The invention relates to microphones, and more particularly to microphone arrays.

2. Description of the Related Art

A microphone array comprises multiple microphones converting sounds received to multiple electrical signals. Because the electrical signals generated by a microphone array have phase difference and gain difference therebetween due to diversity of location, a processor can properly tune specific properties of the electric signals according to the phase difference and gain difference. For example, a processor can improve sensitivity of the microphone array to sounds from specific directions through calculations based on phase differences between the electrical signals. Thus, microphone arrays have more flexible application in high-level sound processing.

FIG. 1 shows a conventional microphone array with microphones connected in parallel to a host. In an embodiment, the host is a processor. The microphone array comprises two microphones 102 and 104. The microphones 102 and 104 respectively convert sounds $S_1$ and $S_2$ to electrical signals. The electrical signals generated by the microphones 102 and 104 are transferred to a host 106 together through a single data path, a configuration referred to as parallel connection. The host 106 provides a clock signal for the microphones 102 and 104. The microphone 102 outputs data at a rising edge of the clock signal, and the microphone 104 outputs data at a falling edge of the clock signal, thus the data path is shared by the two microphones of the array.

Although two microphones of a microphone array can share a data path connecting the host and the microphone array, microphone arrays comprising more than two microphones require extra signal paths leading to the host. A host, such as a processor, however, has only a limited number of data buses and cannot allocate a great number thereof to a microphone array. In addition, data processing loading of a host increases with the number of the microphones connected to the host, because more microphones generate more electrical input signals to the host. Thus, a microphone array reducing data processing loading and bus number of the host is required.

BRIEF SUMMARY OF THE INVENTION

The invention provides a microphone. The microphone receives a first sound signal and at least one second electrical signal and outputs a third electrical signal. In one embodiment, the microphone comprises a transducer and a signal processor. The transducer converts the first sound signal to a first electrical signal. The signal processor has a first input terminal receiving the first electrical signal and at least one second input terminal receiving the at least one second electrical signal, and derives the third electrical signal from the first electrical signal and the second electrical signal. In one embodiment, the at least one second electrical signal is derived from at least one second sound signal by at least one second microphone located in the vicinity of the microphone. In another embodiment, the at least one second electrical signal comprises a wind noise signal derived from wind pressure by a pressure sensor located in the vicinity of the microphone.

The invention also provides a signal processor installed in a first microphone. In an embodiment, the signal processor comprises a plurality of input terminals receiving a plurality of input electrical signals and means for deriving an output signal from the input electrical signals. One of the input electrical signals is a first input electrical signal derived from a first sound signal by a transducer of the first microphone, and another of the input electrical signals is a second input electrical signal derived from a second sound signal by a second microphone located in the vicinity of the first microphone.

The invention also provides a microphone array which outputs a third electrical signal. In one embodiment, the microphone array comprises a first microphone and a second microphone. The first microphone generates a first electrical signal according to a first sound signal. The second microphone is located in the vicinity of the first microphone, has a first input terminal receiving the first electrical signal and a transducer converting a second sound signal to a second electrical signal, and derives the third electrical signal from the first electrical signal and the second electrical signal.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
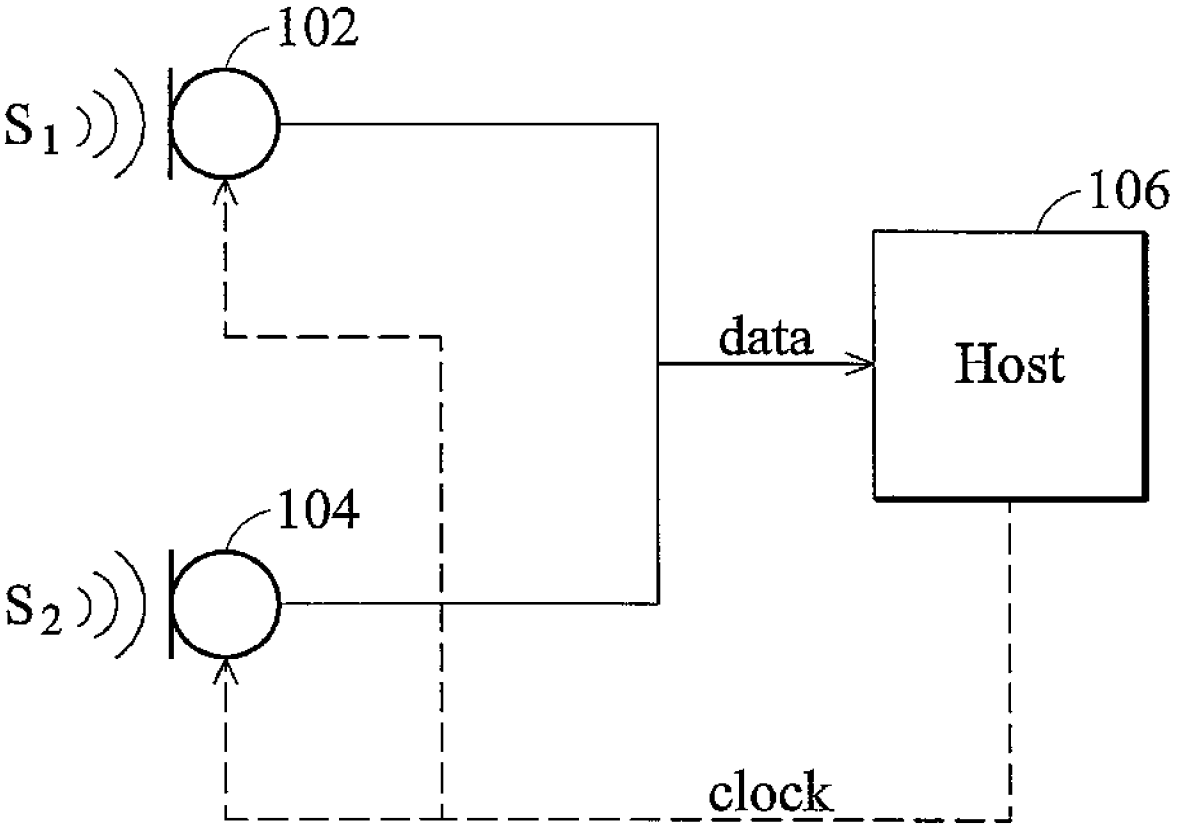
FIG. 1 (PRIOR ART)
FIG. 1 shows a conventional microphone array with microphones connected in parallel to a host.
Figure 2:
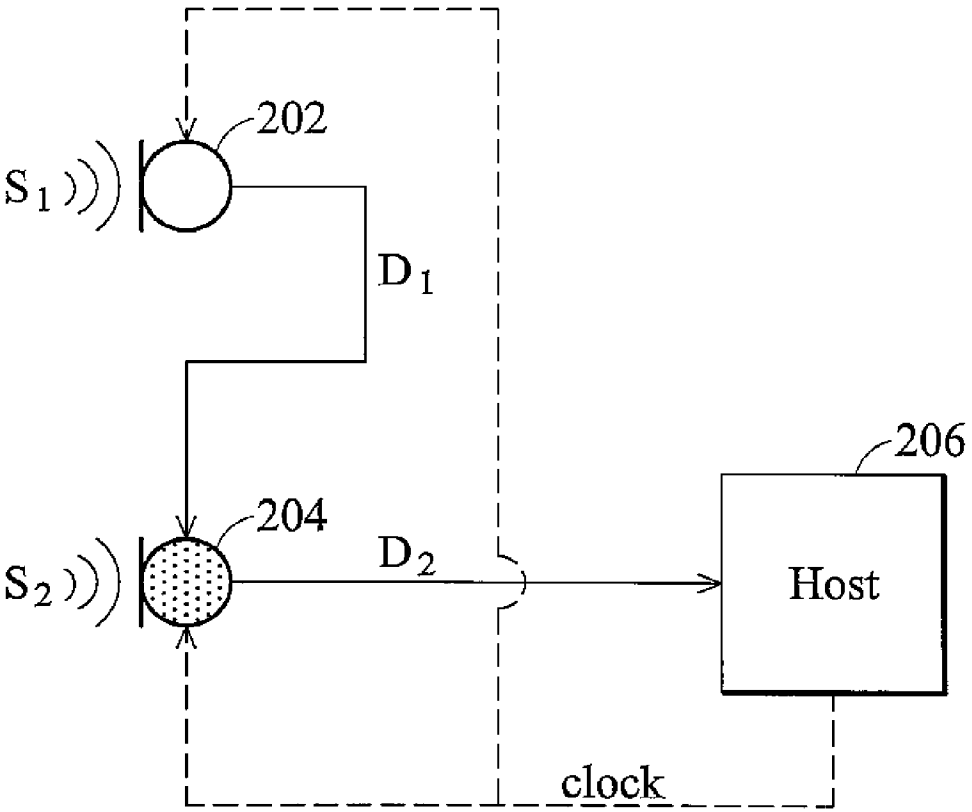
FIG. 2 shows a microphone array with microphones connected in series according to the invention.

FIG. 2 shows a microphone array with microphones connected in series according to the invention. The microphone array comprises two microphones 202 and 204. The microphone 202 converts a sound signal $S_1$ to an electrical signal $D_1$. The microphone 204 located in the vicinity of the microphone 202 also converts a sound signal $S_2$ to an electrical signal $D_3$ (not shown in FIG. 2). Rather than directly outputting the electrical signal $D_3$, the microphone 204 receives the electrical signal $D_1$ generated by the microphone 202 and then derives an output electrical signal $D_2$ from the electrical signal $D_1$ and the second electrical signal $D_3$ converted from the sound signal $S_2$. The electrical signal $D_2$ is then sent to a host 206. In an embodiment, the host is a processor. Because the output signal $D_1$ of the microphone 202 is delivered to the microphone 204, the microphones 202 and 204 are connected in series. Although the clock signal of the microphones 202 and 204 is provided by the host 206 in FIG. 2, the clock signal can be provided by other devices of the system.

The microphone array in FIG. 2 comprises only two microphones for illustration. If a microphone array comprises more than two microphones, the microphones can be repeatedly cascaded as the microphones 202 and 204. Thus, no matter how many microphones a microphone array comprises, the microphone array finally generates only one output signal, and requires only one data bus of the host to transferring the output signal. In addition, because a subsequent microphone 204 processes the electrical signal generated by preceding microphone 202, the microphone array shares a portion of signal processing loading of the host 206. The host 206 needs to process only one output electrical signal $D_2$ of the microphone array even if the microphone array comprises multiple microphones.

Figure 3:
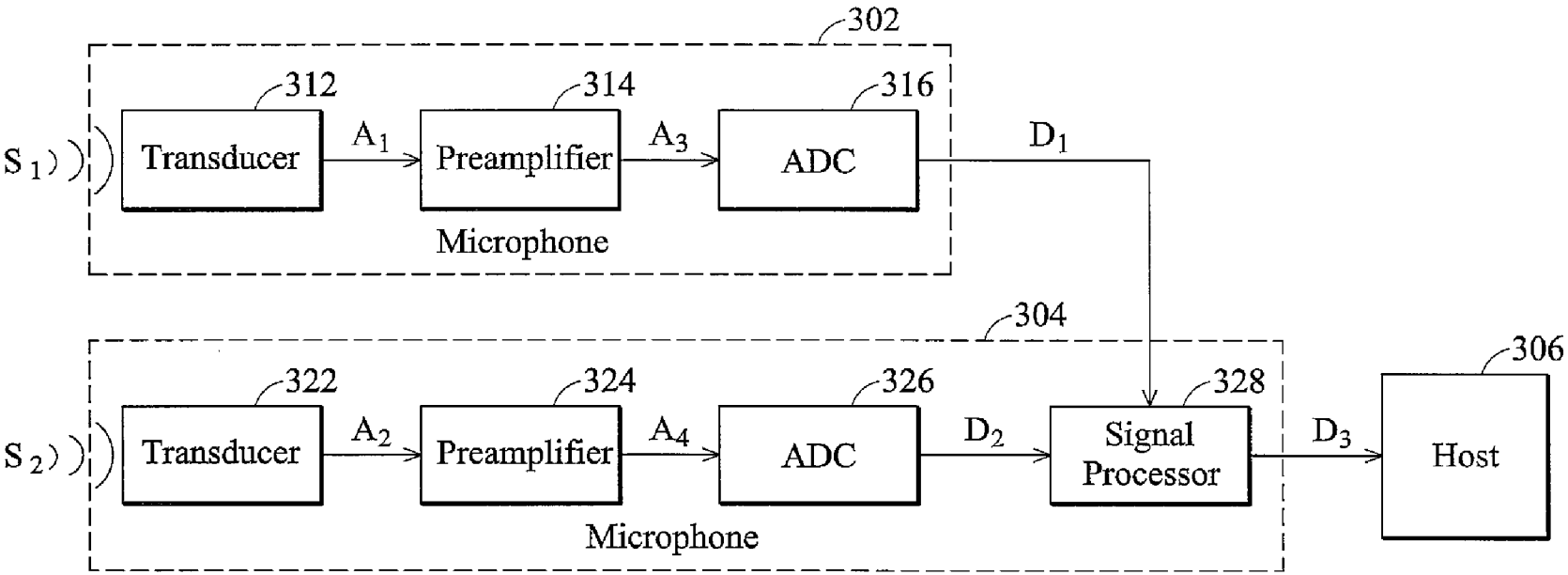
FIG. 3 is a block diagram of serially-connected microphones according to the invention.

FIG. 3 is a block diagram of serially-connected microphones according to the invention. Two microphones 302 and 304 are connected in series. The microphone 302 is a conventional microphone and comprises a transducer 312, a preamplifier 314, and an analog-to-digital converter (ADC) 316. The microphone 304 is a microphone specially designed for serial connection and comprises a transducer 322, a preamplifier 324, an ADC 326, and a signal processor 328. The transducers 312 and 322 respectively convert sound signals $S_1$ and $S_2$ to electrical signals $A_1$ and $A_2$. The preamplifiers 314 and 324 then respectively amplify electrical signals $A_1$ and $A_2$ to electrical signals $A_3$ and $A_4$. The ADC 316 and 326 then respectively converts electrical signals $A_3$ and $A_4$ from analog to digital to obtain electrical signals $D_1$ and $D_2$.

The microphone 302 then outputs the electrical signal $D_1$. The signal processor 328 of the microphone 304 then processes electrical signals $D_1$ and $D_2$ to generate an electrical signal $D_3$, which is the output signal of the microphone 304 and delivered to a host 306. By combining the signals $D_1$ and $D_2$, the signal processor 328 can generate signal $D_3$ with better quality than the signals $D_1$ and $D_2$. Signal processor 328 derives the signal $D_3$ based on the attribute of the output signal of the microphone array a system designer wants to improve. For example, the system designer may aim at improving sound sensitivity of the microphone 304 or compensating phase difference or gain difference between the signals $D_1$ and $D_2$. The signal processor 328 can also make the microphone 304 more sensitive to sounds from a specific direction, thus turning the microphone 304 into a unidirectional microphone. The internal structure and operation of the signal processor 328 is further illustrated in FIGS. 6 and 7.

Figure 4B:
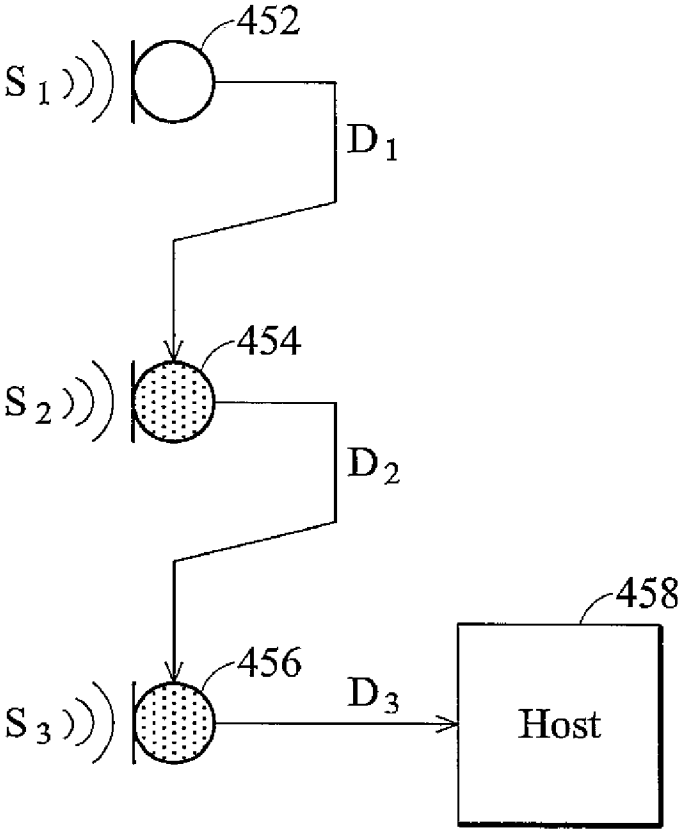
FIG. 4B shows three microphones cascaded in a hierarchy.
Figure 4A:
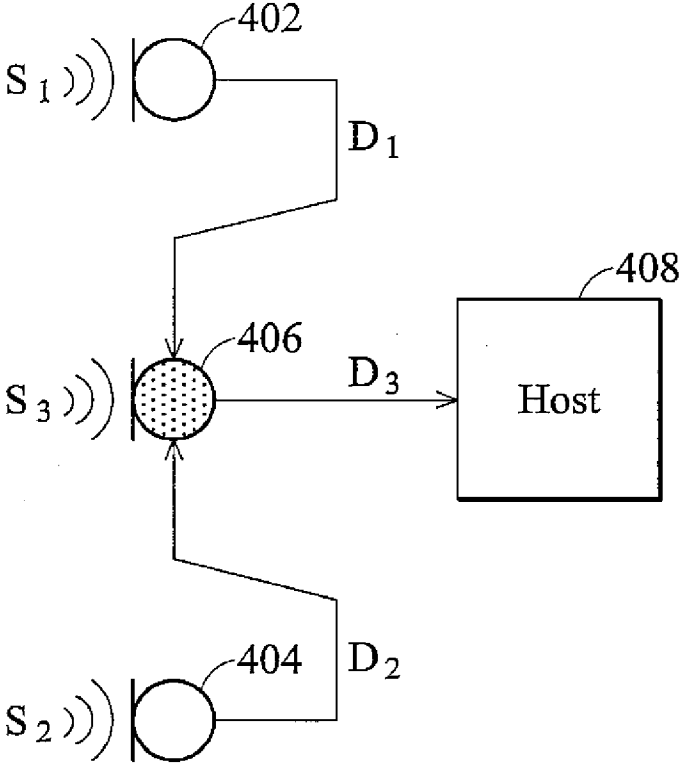
FIG. 4A shows a microphone simultaneously connected with other two microphones in series.

A microphone with a signal processor can receive more than one electrical signal output by other microphones. FIG. 4A shows a microphone 406 simultaneously connected with other two microphones 402 and 404 in series. The microphones 402 and 404 are conventional microphones and respectively convert sound signals $S_1$ and $S_2$ to electrical signals $D_1$ and $D_2$. The microphone 406 converts a sound signal $S_3$ to an electrical signal $D_4$ (not shown in FIG. 4A) and then derives an electrical signal $D_3$ from the signals $D_1$, $D_2$, and $D_4$. The signal $D_3$ is finally delivered to the host 408. Thus, the microphone 406 is serially connected with the microphones 402 and 404.

Microphones of a microphone array also can be cascaded in a hierarchy. FIG. 4B shows three microphones 452, 454, and 456 cascaded in a hierarchy. The microphone 452 converts a sound signal $S_1$ to an electrical signal $D_1$. The microphones 454 and 456 have signal processors and can receive output signals of other microphones. The microphone 454 is cascaded with the microphone 452, and the microphone 456 is further cascaded with the microphone 454. The microphone 454 first converts a sound signal $S_2$ to an electrical signal $D_4$ (not shown in FIG. 4B) and then generates an electrical signal $D_2$ according to the signals $D_4$ and $D_1$. The microphone 456 also converts a sound signal $S_3$ to an electrical signal $D_5$ (not shown in FIG. 4B) and then generates an electrical signal $D_3$ according to the signals $D_5$ and $D_2$. The signal $D_3$ is finally delivered to the host 458. Thus, the three microphones 452, 454, and 456 are cascaded in a hierarchy.

Figure 5:
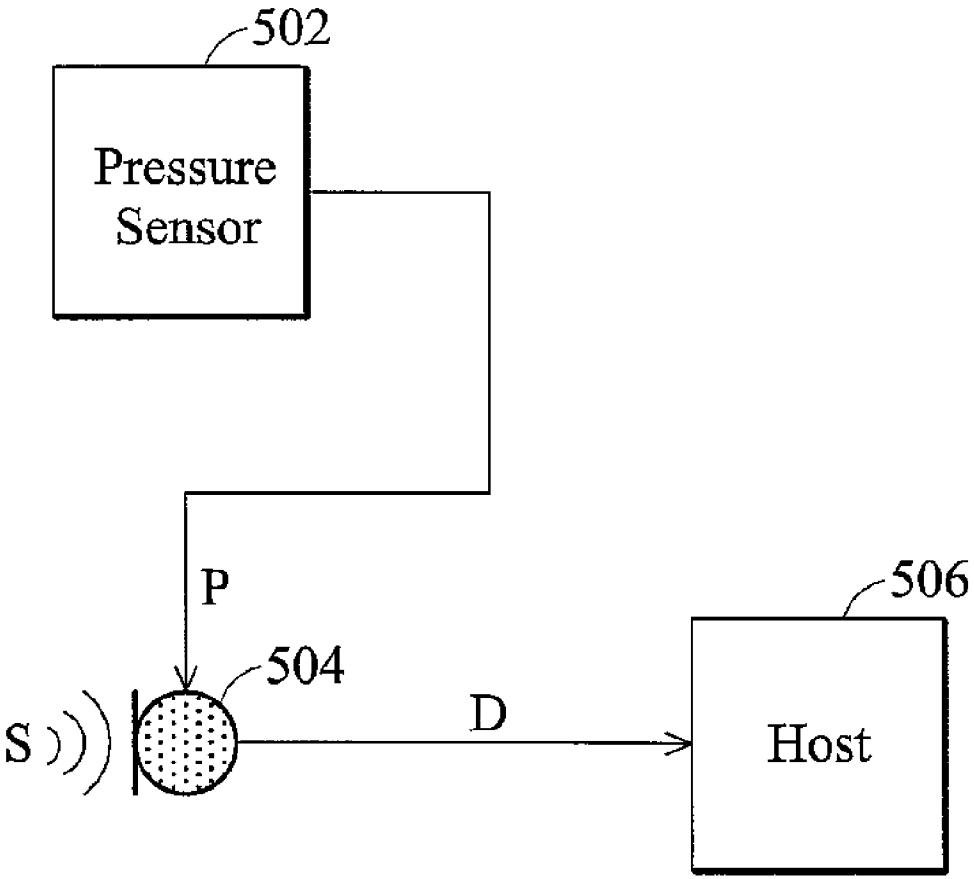
FIG. 5 shows a microphone capable of eliminating wind noise.

A microphone with a signal processor can also receive electrical signals not generated by microphones. FIG. 5 shows a microphone 504 capable of eliminating wind noise. The microphone 504 converts a sound signal S to an electrical signal D. If the sound signal S propagates in moving air, propagation of the sound signal S is disturbed by wind, and the electrical signal D carries wind noise. The wind noise can be removed by a pressure sensor 502. The pressure sensor 502 senses winds and converts air pressure to an electrical signal P, and the microphone 504 then eliminates wind noise from the signal D according to the signal P. Thus, the signal D with no wind noise has better quality.

Figure 6A:
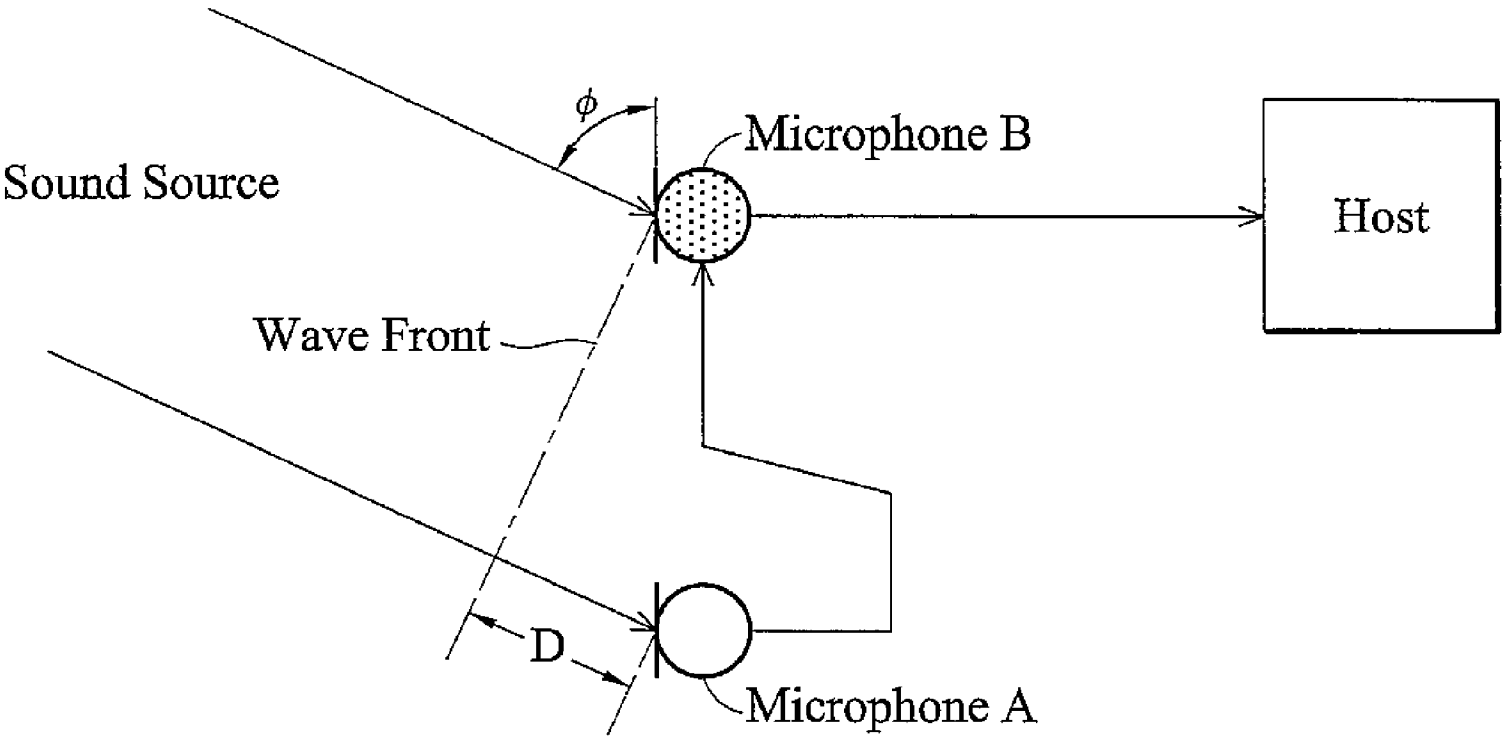
FIG. 6A shows two omnidirectional microphones connected in series.
Figure 6B:
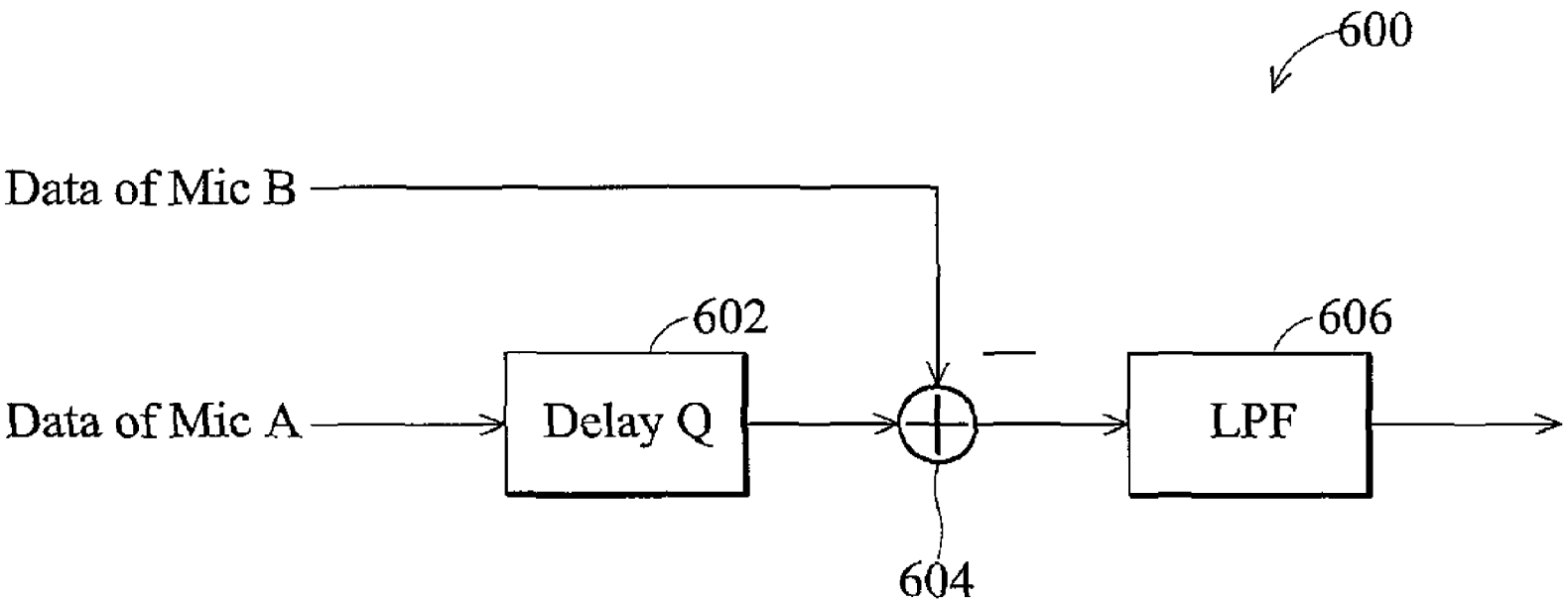
FIG. 6B is a block diagram of a signal processor driving the microphones in FIG. 6A to a unidirectional operation.
Figure 6C:
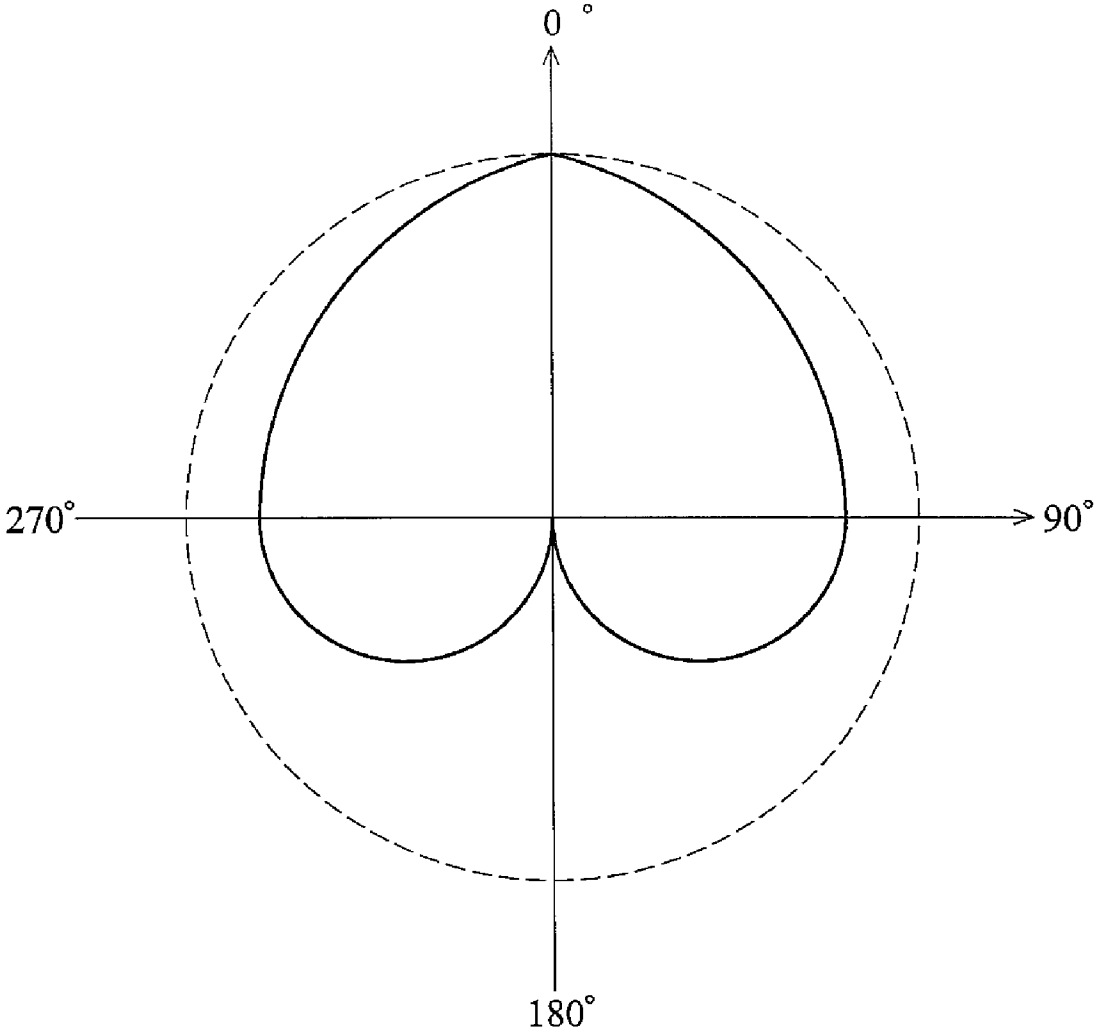
FIG. 6C shows a polar pattern of the output signal of the signal processor in FIG. 6B.

FIG. 6A~6C shows a microphone array converting two omnidirectional microphones thereof into a unidirectional microphone. FIG. 6A shows two omnidirectional microphones A and B connected in series. A sound source is distant from the microphones A and B and generates a sound signal. When the sound signal approaches the microphones A and B, it is almost a plane wave. The wave front of the sound signal first reaches the microphone B and then the microphone A. Thus, in comparison with the microphone B, the microphone A receives the sound signal with a delay time T, because the sound signal must travel an extra distance D to reach the microphone A.

If the distance between sound inlets of the microphones A and B is d, the extra distance D is equal to ($d \times \cos\phi$), wherein $\phi$ is the incident angle of the sound signal. Thus, if the sound signal propagates in the air with a velocity V, the delay time T is determined by the following algorithm:

$$T = \frac{D}{V} = \frac{d \times \cos\phi}{V}.$$

FIG. 6B is a block diagram of a signal processor 600 of the microphone B in FIG. 6A. The signal processor 600 comprises a delay module 602, a subtractor 604, and a low pass filter 606. The microphones A and B respectively convert the sound signal to datastreams. The delay module 602 delays datastream generated by the microphone A for a delay time Q. The subtractor 604 then subtracts datastream of the microphone B from the delayed datastream of the microphone A to obtain a remainder datastream. Finally, the low pass filter 606 filters the remainder datastream to generate an output signal of the microphone B.

If the sound signal is monotone, the sound signal can be modeled as a sine wave. If the delay time Q=d/V, the output signal of the subtractor 604 is determined by the following algorithm:

$$\text{Sum}=A(\text{delay}=Q)-B=\sin[2\pi F(t+Q)]-\sin[2\pi F(t+T)];$$

If the incident angle $\phi$ is 180°, the output signal is zero. If the incident angle $\phi$ is 0°, the output signal is not zero but slightly attenuated. The attenuation rate is a function of frequency and can be compensated by the low pass filter 606.

FIG. 6C shows a polar pattern of the output signal of the signal processor 600 in FIG. 6B. The dashed line is a 0 dB attenuation line. The solid line is the gain of the output signal generated by the signal processor 600 for different incident angle $\phi$. When the incident angle $\phi$ is 0°, the gain is 0 dB (no attenuation). The gain attenuates with increase of the incident angle. When the incident angle $\phi$ is 180°, the gain is zero. Thus, although the two microphones A and B are originally omnidirectional microphones, the signal processor 600 of the microphone B generates an output signal especially sensitive to sounds coming from a specific direction. Sounds coming from other directions are suppressed. Thus, the microphones A and B are combined to form a unidirectional microphone. Because all the signal processing is completed by the signal processor 600, processing load of the subsequent host is greatly alleviated.

Figure 7:
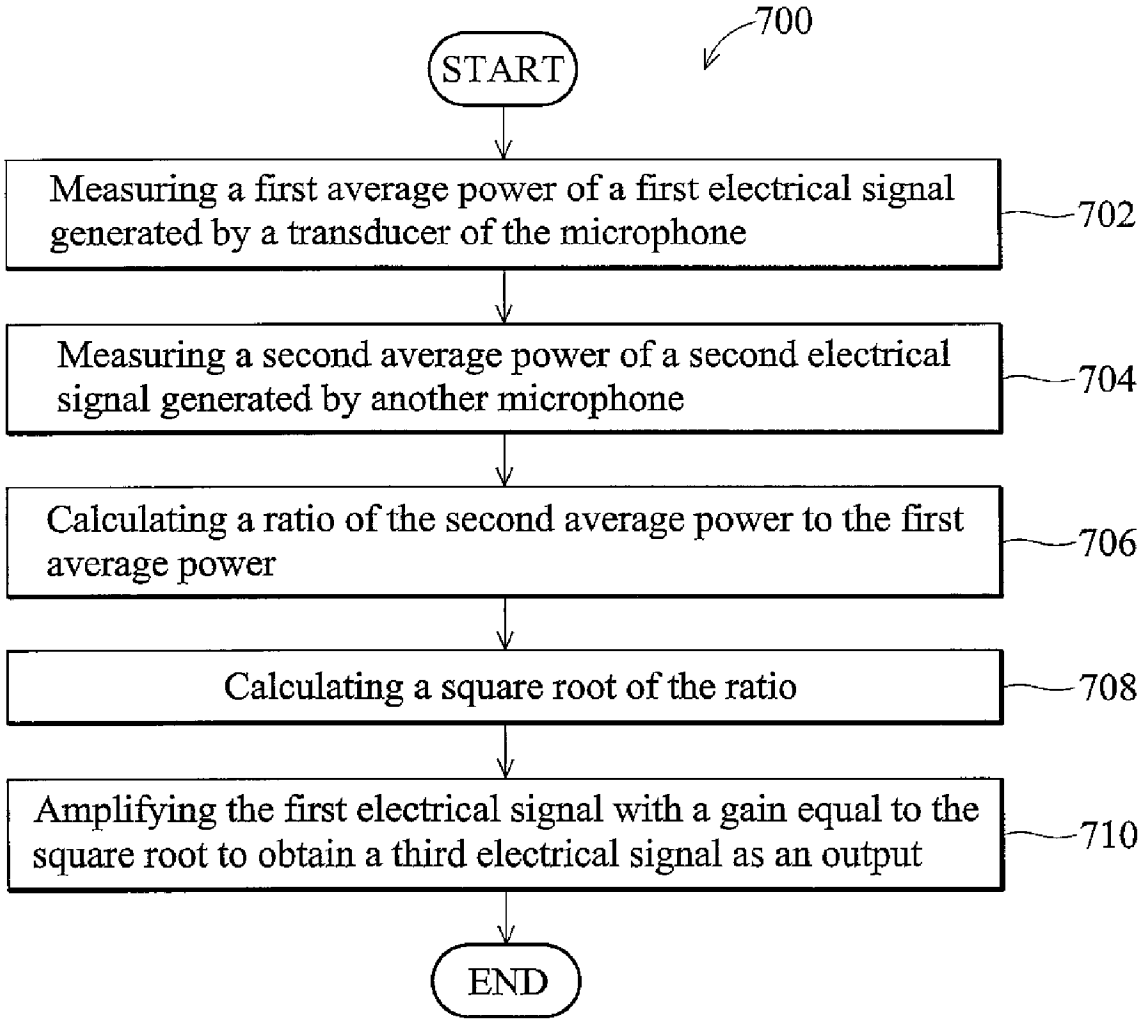
FIG. 7 is a flowchart of a method for improving sound sensitivity of a microphone with a signal processor.

Signal processors can also increase sound sensitivity of microphones. A sound sensitivity of a microphone is defined as a ratio of an input sound power to an output electrical signal power of the microphone. FIG. 7 is a flowchart of a method 700 for improving a sound sensitivity of a microphone with a signal processor. The microphone array comprising microphone 202 and 204 in FIG. 2 is cited as an example for illustrating the method 700. If a distance between the microphones 202 and 204 is less than 3 cm, the sound powers received by the microphones 202 and 204 are similar. If microphone 202 has an output signal power greater than that of the microphone 204, the signal processor of the microphone 204 can increase the output signal power of the microphone 204 according to the method 700.

The microphone 204 converts a sound signal $S_2$ to an electrical signal $D_3$ (not shown in FIG. 2) with a transducer thereof. The signal processor of the microphone 204 first measures an average power $P_B$ of the electrical signal $D_3$ in step 702. The microphone 202 converts a sound signal $S_1$ to an electrical signal $D_1$, and the signal processor measures an average power $P_A$ of the electrical signal $D_1$ in step 704. The signal processor then calculates a ratio R of the average power $P_A$ to the average power $P_B$ in step 706 ($R=P_A/P_B$), and a square root of the ratio R is also calculated in step 708. Finally, the signal processor amplifies the electrical signal $D_3$ with a gain of $\sqrt{R}$ to generate an output electrical signal $D_2$ in step 710 ($D_2=\sqrt{R}\times D_3$). Thus, the power of the output signal $D_3$ is roughly equal to the power of the output signal $D_1$ of the microphone 202. Because an amplitude of the output electrical signal $D_2$ is increased in response to an amplitude of the sound signal $S_2$, the sound sensitivity of the microphone 204 is increased.

The invention provides microphones connected in series. A microphone with a signal processor installed therein can generate an electrical signal according to a received sound signal and the output signals of other microphones serially connected thereto. Thus, the serially connected microphones finally generate only one output signal which requires only one data bus to transfer to a host. In addition, the signal processors of microphones share a portion of processing load of the host.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microphone, receiving a first sound signal and at least one second electrical signal and outputting a third electrical signal, comprising:

a transducer, converting the first sound signal to a first electrical signal; and a signal processor, having a first input terminal receiving the first electrical signal and at least one second input terminal receiving the at least one second electrical signal, calculating a power ratio of the second electrical signal to the first electrical signal, calculating a square root of the power ratio, and amplifying the first electrical signal with a gain equal to the square root to obtain the third electrical signal.

2. The microphone as claimed in claim 1, wherein the at least one second electrical signal is derived from at least one second sound signal by at least one second microphone located in the vicinity of the microphone.

3. The microphone as claimed in claim 1, wherein the at least one second electrical signal comprises a wind noise signal derived from wind pressure by a pressure sensor located in the vicinity of the microphone, and the signal processor eliminates wind noise from the first electrical signal according to the wind noise signal to obtain the third electrical signal without wind noise.

4. The microphone as claimed in claim 2, wherein the signal processor derives the third electrical signal in a manner making the third electrical signal sensitive to sounds from a specific direction, thus turning the microphone into a unidirectional microphone.

5. The microphone as claimed in claim 4, wherein the signal processor comprises:

a delay module, delaying the second electrical signal to obtain a delayed signal;

a subtractor, coupled to the delay module, subtracting the first electrical signal from the delayed signal to obtain a fourth electrical signal; and a low pass filter, coupled to the subtractor, filtering the fourth electrical signal to obtain the third electrical signal.

6. The microphone as claimed in claim 2, wherein the signal processor derives the third electrical signal in a manner increasing an amplitude of the third electrical signal responsive to an amplitude of the first sound signal, thus increasing the sensitivity of the microphone.

7. The microphone as claimed in claim 1, wherein the signal processor compensates the first electrical signal for a phase difference between the first electrical signal and the second electrical signal.

8. A signal processor, installed in a first microphone, comprising:

a plurality of input terminals, receiving a plurality of input electrical signals; and means for deriving an output signal from the input electrical signals;

wherein one of the input electrical signals is a first input electrical signal derived from a first sound signal by a transducer of the first microphone, and another of the input electrical signals is a second input electrical signal derived from a second sound signal by a second microphone located in the vicinity of the first microphone;

wherein the signal processor calculates a power ratio of the second input electrical signal to the first input electrical signal, calculates a square root of the power ratio, and amplifies the first input electrical signal with a gain equal to the square root to obtain the output signal, thus raising the sensitivity of the first microphone to a level similar to the second microphone.

9. The signal processor as claimed in claim 8, wherein still another of the input electrical signals is a wind noise signal derived from wind pressure by a pressure sensor located in the vicinity of the first microphone, and the signal processor generates the output signal with no wind noise according to the wind noise signal.

10. The signal processor as claimed in claim 8, wherein the signal processor derives the output signal in a manner making the output signal sensitive to sounds from a specific direction, thus turning the first microphone into a unidirectional microphone.

11. The signal processor as claimed in claim 10, wherein the means for deriving the output signal comprising:

a delay module, delaying the second input electrical signal to obtain a delayed signal;

a subtractor, coupled to the delay module, subtracting the first input electrical signal from the delayed signal to obtain a fourth electrical signal; and a low pass filter, coupled to the subtractor, filtering the fourth electrical signal to obtain the output signal.

12. The signal processor as claimed in claim 8, wherein the signal processor derives the output signal in a manner increasing an amplitude of the output signal responsive to an amplitude of the first sound signal, thus increasing the sensitivity of the first microphone.

13. The signal processor as claimed in claim 8, wherein the signal processor compensates the first input electrical signal for a phase difference between the first input electrical signal and the second input electrical signal.

14. A microphone array, outputting a third electrical signal, comprising:

a first microphone, generating a first electrical signal according to a first sound signal; and a second microphone, located in the vicinity of the first microphone, having a first input terminal receiving the first electrical signal and a transducer converting a second sound signal to a second electrical signal, calculating a power ratio of the second electrical signal to the first electrical signal, calculating a square root of the power ratio, and amplifying the first electrical signal with a gain equal to the square root to obtain the third electrical signal.

15. The microphone array as claimed in claim 14, wherein the microphone array further comprises a pressure sensor detecting wind pressure to obtain a fourth electrical signal, and the second microphone eliminates wind noise from the third electrical signal according to the fourth electrical signal.

16. The microphone array as claimed in claim 14, wherein the second microphone derives the third electrical signal in a manner making the third electrical signal sensitive to sounds from a specific direction, thus turning the second microphone into an unidirectional microphone.

17. The microphone as claimed in claim 14, wherein the second microphone derives the third electrical signal in a manner increasing an amplitude of the third electrical signal responsive to an amplitude of the second sound signal, thus increasing the sensitivity of the second microphone.

18. The microphone array as claimed in claim 14, wherein the second microphone compensates the second electrical signal for a phase difference between the first electrical signal and the second electrical signal.

* * * * *